United States Patent [19]

Schroeder

[11] Patent Number: 4,958,167

[45] Date of Patent: Sep. 18, 1990

[54] ULTRA-BROADBAND IMPEDANCE MATCHED ELECTRICALLY SMALL COMPLEMENTARY SIGNAL RADIATING STRUCTURES USING THIN WIRE ELEMENTS AND AN IMPEDANCE OPTIMIZING FEED CIRCUIT

[76] Inventor: Klaus G. Schroeder, 104 County Line Rd., Lansdale, Pa. 19446

[21] Appl. No.: 204,085

[22] Filed: Jun. 7, 1988

Related U.S. Application Data

[63] Continuation-in-part of Ser. No. 97,522, Sep. 16, 1987, Pat. No. 4,750,000.

[51] Int. Cl.[5] ..... H01Q 21/00

[52] U.S. Cl. ..... 343/853; 343/713

[58] Field of Search ..... 343/713, 715, 749, 751, 343/813, 814, 816, 822, 853, 860, 900, 844

[56] References Cited

U.S. PATENT DOCUMENTS 4,750,000 6/1988 Schroeder ..... 343/853

*Primary Examiner*—William L. Sikes
*Assistant Examiner*—Robert E. Wise
*Attorney, Agent, or Firm*—Warren H. Kintzinger

[57] ABSTRACT

Ultra-broadband impedance matched electrically small complementary-pair antennas using thin wire elements with impedance optimizing feed are presented. Efficiencies are determined by achieveable loss resistances in the radiating structure itself, rather than the (limited) quality of an external loading coil; and by energy channeled into the difference port of the feed hybrid, that is used to match two complementary impedances. Broad and impedance loci are achieved for the thin radiators by horizontal feed bars placed prior to the complementarizing circuit. Impedance matching is then accomplished in a standard broadband hybrid or "Magic Tee" feed circuit, which combines either two identical elements, where one has been "complementarized", or there are twoself-complementary elements, such as a monopole and a half-loop.

7 Claims, 4 Drawing Sheets

Figure 1:
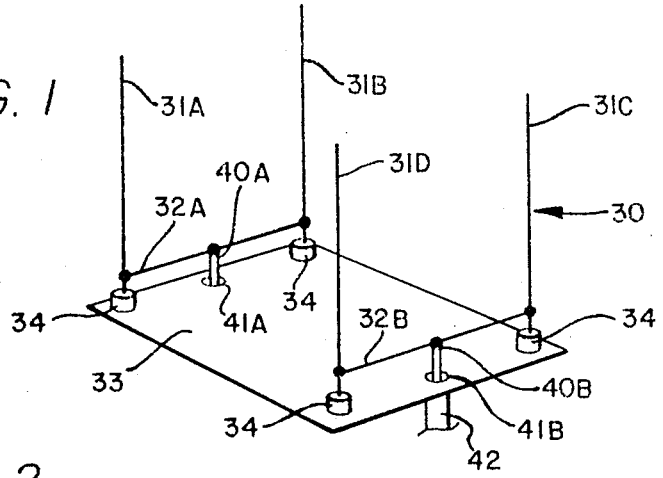

ULTRA-BROADBAND IMPEDANCE MATCHED ELECTRICALLY SMALL COMPLEMENTARY SIGNAL RADIATING STRUCTURES USING THIN WIRE ELEMENTS AND AN IMPEDANCE OPTIMIZING FEED CIRCUIT

This is a Continuation-in-Part of my co-pending application Ser. No. 07/097/,522, filed Sept. 16, 1987, now U.S. Pat. No. 4,750,000.

This invention relates in general to various antenna systems with broadband operational capabilities, and in particular, to antenna systems utilizing complementary paired element groups in impedance matched electrically small signal radiating structures with horizontal feed bar feed for complementary pairs using thin wire elememts.

With large, in terms of wavelength, unidirectional antenna arrays in the HF, VHF and UHF frequency ranges where more than approximately an octave of bandwidth is required, the untuned element VSWR (voltages standing wave radio) in front of a reflector is usually around 2:1. This results, with many existing antenna systems, in problems with large amounts of reflected power disturbing, for example, phasing circuit mechanisms (particularly under beam steering conditions) which can also overload a transmitter.

It is known that fat monopoles, arrayed in endfire, can be impedance-matched over at least a 3:1 frequency range. The conical monopoles required for this performance typically have included cone angles of 60 degrees and length-to-diameter ratios of less than approximately 4:1. Solid monopole complementary pair arrays, however are not very practical for HF and VHF, particularly in mobile applications. A standard way to build conical monopoles at those frequencies is the wire-cage construction.

To implement a quasi-short monopole (height between one-sixth of a wavelength and half a wavelength) in wire-cage construction, typically six to eight wires are required, which shape the outline of the cone and attached cylinder. Keeping in mind that this provides one monopole, a second wire-cage structure has to be added to the first one to form a pair. This then leads to twelve wires minimally in an endfire complementay pair of conical wire-cage monopoles.

These wire-cage structures now have to be supported somehow, which leads either to an almost impractical complex array and support structure, or the need for twelve individually self-supporting whips forming the wire-cage outlines in the vertical direction.

The desire clearly exists to further reduce the number of vertical radiators. It is known that the conical cylindrical monopoles can be replaced by their eqivalent flat sheet monopoles provided the width of the sheet is twice the diameter of the cylinder. An endfire pair may be used with the pair using solid sheets of conducting material.

Such solid-sheet "equivalent" arrays offer no advantage, of course, unless the sheets are also configured in thin-wire construction technique with flat sheet monopoles simulated by using just two wires or two whips, thus reducing the total number of elements to four. No connection is required between the tops of the whips, but they are connected at each pair bottom with horizontal connecting bar.

The ultra-broadband self-complementary pairs of elements presented are based to some degree on some concepts previously formulated and presented in my previous U.S. Pat. No. 3,449,751 issued Jun. 10, 1969 and titled "Complementary Pair Antenna Element Groups". This is with pairs of elements using a 180 degree feed hybrid to impedance match two radiators that are closely spaced and enhance each other's radiating properties and that have impedances which are complementary. In the past, mutual coupling between closely spaced radiators has prevented the physical realization of such a pair, except for a vertical monopole/slot combination that did not use a hybrid feed. The evolution of a monopole/half loop combination is now presented that both overcomes the mutual coupling problem and, at the same time, results in a more practical monopole structure for mobile applications.

The complementary matching approach is based on the impedance averaging properties of a magic-tee or 180-degree hybrid. The generalized impedance relations at the outputs of 180-degree hybrid used in a sides with respect to the center of a Smith Chart. It can be shown that the sum-port impedance is always the center point of a straight line connecting two impedances on a Smith Chart, even if this line does not go through the center, i.e., even if the two impedances are not exactly complementary. Physical embodiments of a self-complementary pair of small elements consist of loops (half-loops) and monopoles; slots and monopoles (dipoles); dipoles and folded dipoles, etc. The end-fire complementary pair is formed by using two identical monopole elements and externally complementarizing one of them by a network such as a delay line. This end-fire pair is now not only matched with respect to the self-impedances of the two elements, but also with respect to mutual impedances in a phased array environment. However, the bandwidth of the complementarizing network generally limits the total pair bandwidth to about 4:1. For applications where 10:1 total bandwidth or more is required, the self-complementary approach currently offers a better solution.

It is therefore a principal object of this invention to provide energy efficient antenna systems producing desired radiation patterns and desired broadband impedance matching.

Another object is to provide electrically small complementary pair element group antenna structures with such energy efficiency and greatly expanded broadband range adaptable impedance matching.

A further object is to provide such efficient antenna systems and complementary pair element group antenna structures and impedance matching feed systems that aid in preventing transmitter overload.

Still another object is to reduce the number of vertical radiators in an antenna systems.

Another object is to provide such antenna systems with electrically small complementary pair element group antenna structures that are physically small enough to be readily adapted for vehicle installation and elsewhere where space and size constraints are an important factor.

Features of the invention useful in accomplishing the above objects include, in ultra-broadband impedance matched electrically small complementary signal radiating structures with, thin wire elements and horizontal feed bars such that efficiencies are determined by achieveable loss resistances in the radiating structure itself, rather than the (limited) quality of an external loading coil, and by energy channeled into the difference part of the feed hybrid, that is used to match complementary impedances. Broadband impedance loci are achieved for the thin radiators by horizontal feed bars placed prior to the complementarizing circuit. Impedance matching is then accomplished in a standard broadband hybrid or "Magic Tee" feed circuit.

Specific embodiments representing what are presently regarded as the best modes of carrying out the invention are illustrated in the accompanying drawings.

Figure 2:
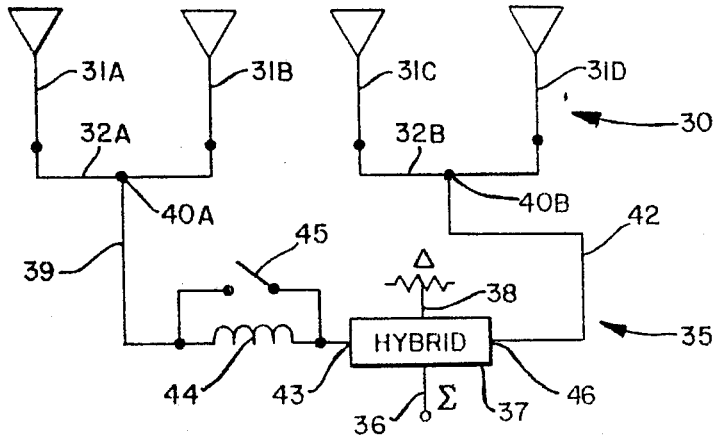
Figure 3:
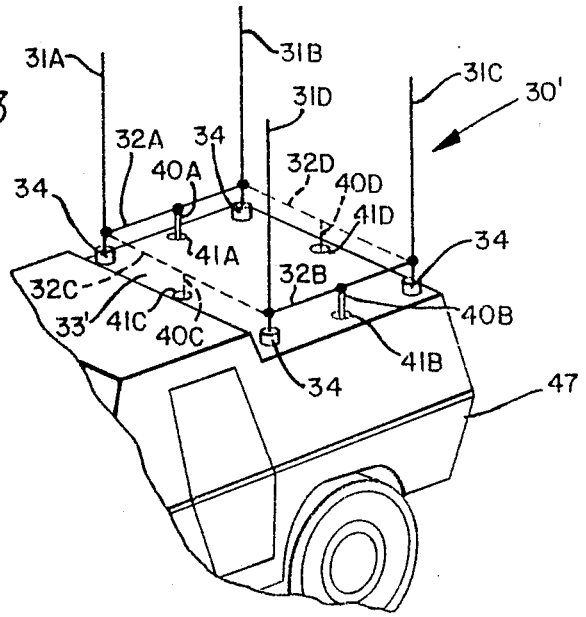
Figure 4:
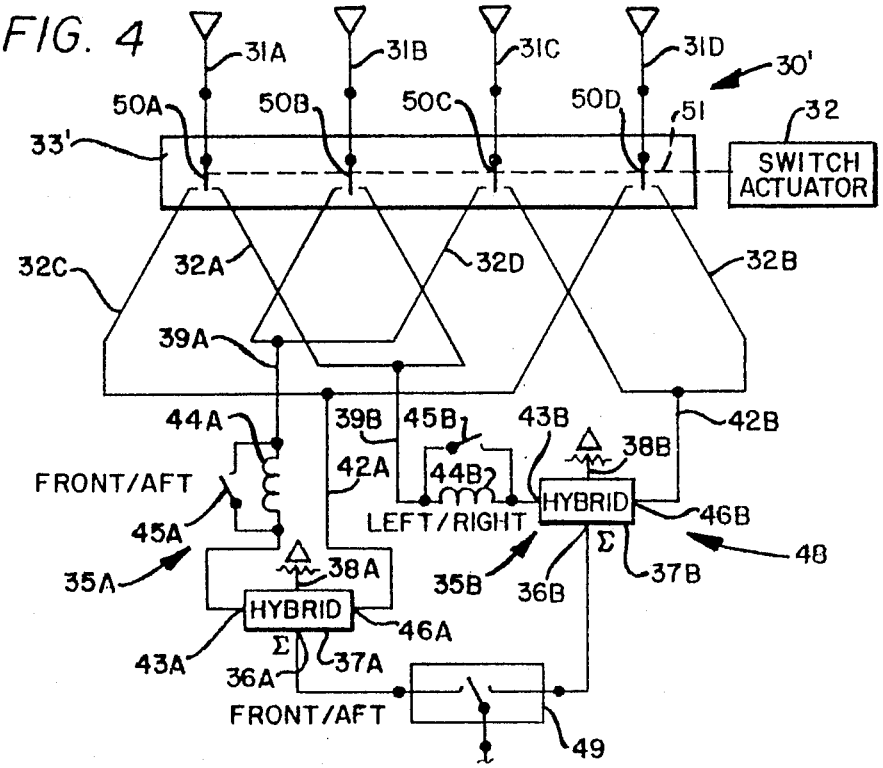
Figure 5:
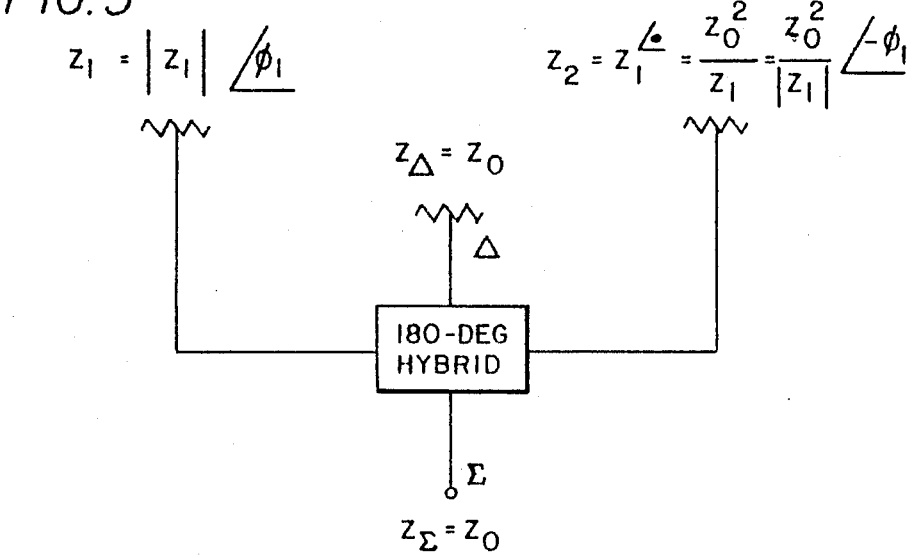
Figure 6:
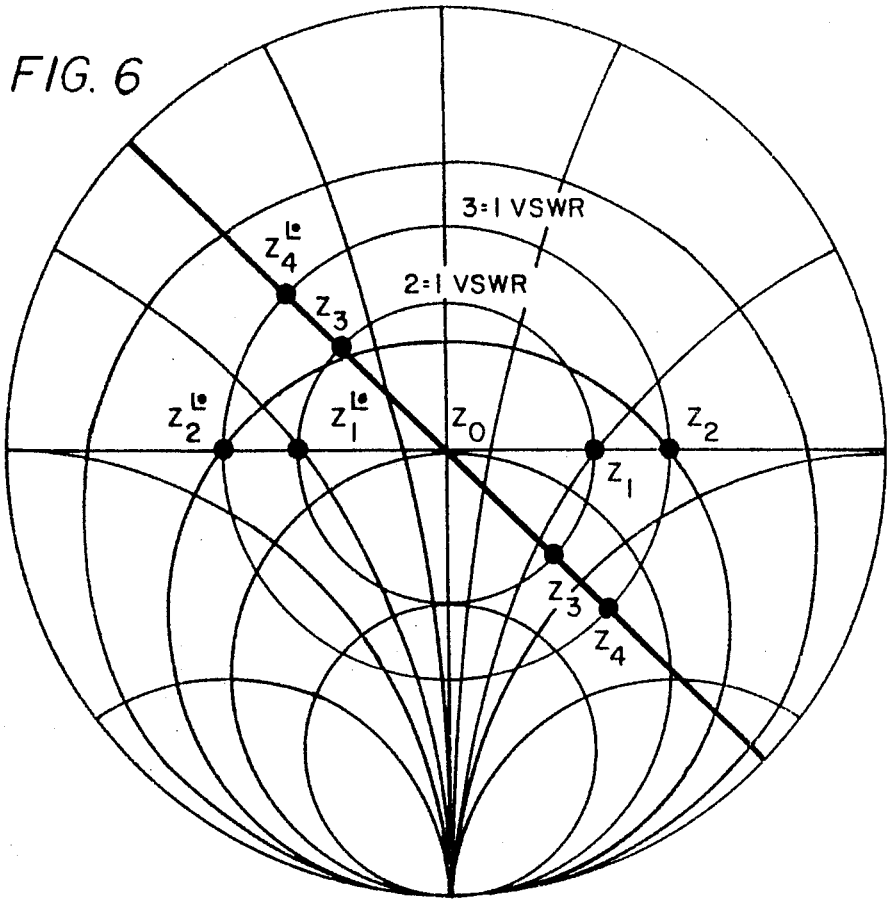
Figure 7:
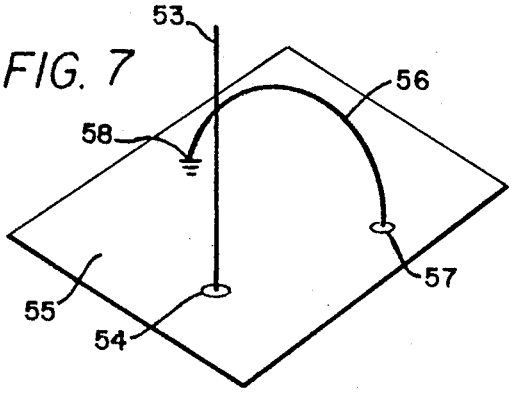
Figure 8:
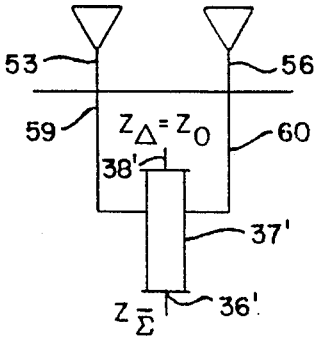
Figure 9:
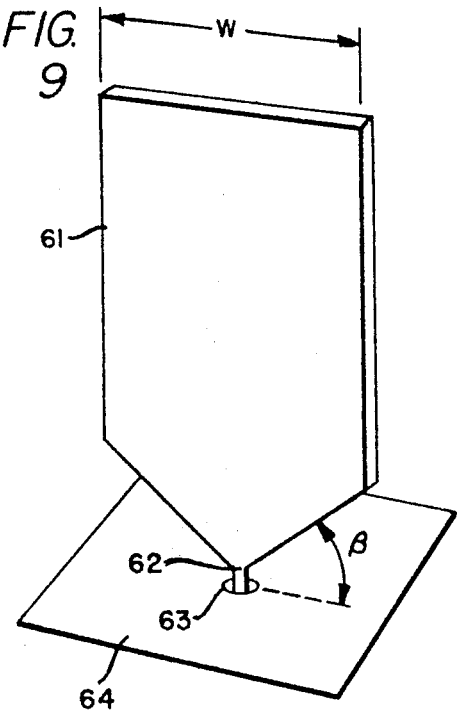
Figure 10:
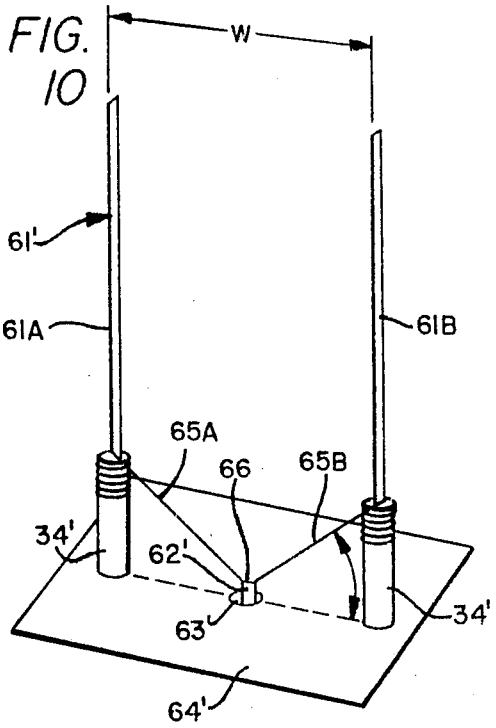
Figure 11:
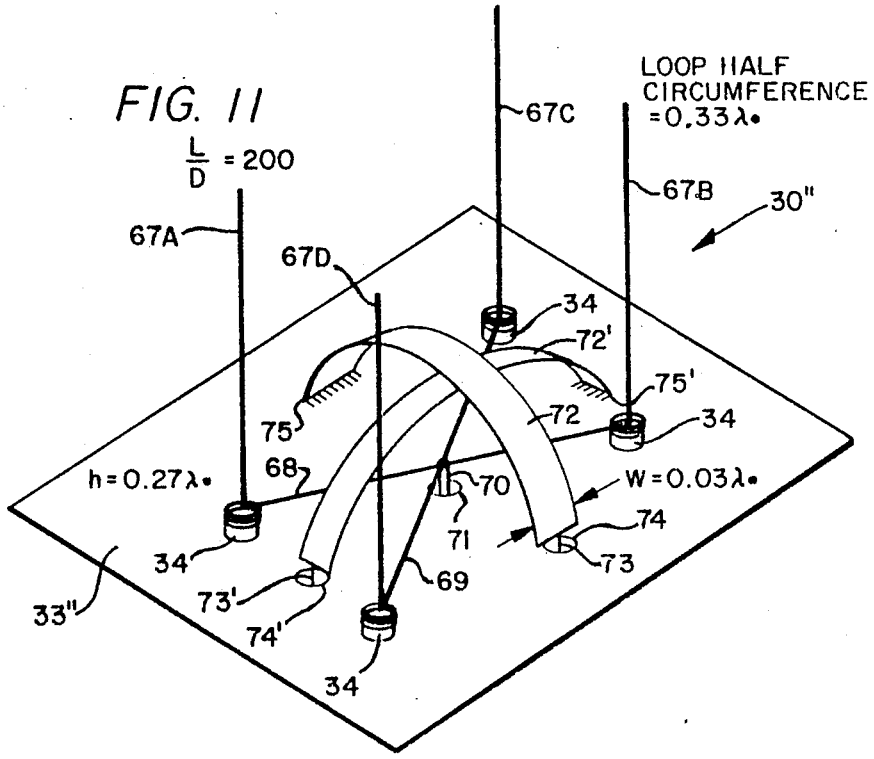

IN THE DRAWINGS:

FIG. 1 represents a perspective view of an antenna feed bar and whip layout of an end-fire complementary pair of equivalent sheet monopoles simulated by dual whips fed from horizontal feed bars mounted on a conductive material ground plane;

FIG. 2, a block schematic showing the hybrid feed circuit for the antenna systems in FIG. 1;

FIG. 3, a partial perspective view of a vehicle mounting the antenna system of FIG. 1 with, however, additional feed bars indicated;

FIG. 4, a block schematic showing of a hybrid feed circuit such as would be used for the antenna system of FIG. 3 with the additional feed bars;

FIG. 5, a combination block schematic illustration of the general impedance relations involved in use of 180 degree hybrids;

FIG. 6, a Smith Chart showing of arbitrary complementary loads with approximately 2:1 and 3:1 standing wave ratios;

FIG. 7, a whip and half-loop self-complementary impedance matching antenna system mounted on a ground plane;

FIG. 8, a block schematic showing of the hybrid self-complementary impedance matching feed for the antenna system of FIG. 7;

FIG. 9, a perspective showing of the flat sheet monopole equivalent of a cylindrical monopole mounted on a ground plane where the width W of the flat monopole is twice the diameter of its cylindrical monopole equivalent;

FIG. 10, a perspective view of the sheet wire outline monopole mounted on a ground plane equivalent of the flat sheet monopole of FIG. 9 and,;

FIG. 11, a perspective view of a self complementary pair of equivalent conical monopole wire-outline radiator and fat strip half-loop radiator antenna system with four whips and two right angle related fat strip half radiators.

REFERRING TO THE DRAWINGS:

The antenna system 30 of FIG. 1 includes radiating whips 31A, 31B, 31C and 31D with whips 31A and 31B fed from a horizontal feed bar 32A that is an open wire transmission line, and whips 31C and 31D fed from a horizontal feed bar 32B that is an open wire transmission line mounted on and above electrically conductive material ground plane sheet 33. The antenna radiating whips 31 are standard fiberglass whips with conducting braid embedded in fiberglass mounted by spring and base insulator units 34 on the ground plane sheet 33.

The hybrid feed circuit 35 of FIG. 2 used for feeding the antenna system 30 of FIG. 1 has an input Σ sum port 36 to 180 degree hybrid 37 having a difference Δ port 38 that is terminated, and the output impedances are complementary with respect to the characteristic impedance of the hybrid, $Z_o$.

A coaxial cable feed line 39 with an effective length $l_1$ has an outer sheath termination connection with the bottom of ground plane 33 and an inner conductor connection 40A to the center of horizontal feed bar 32A with the inner conductor extending through ground plane opening 41A. In like manner coaxial cable feed line 42 with an effective length $l_2$ has an outer sheath termination connection with the bottom of ground plane 33 and an inner conductor connection 40B to the center of horizontal feed bar 32B with the inner conductor extending through ground plane opening 41B. The coaxial cable feed line 39 is connected to 180 degree hybrid output port 43 delay line 44, having an effective electrical length of $2\Delta l$, that has a switch 45 connected across the delay line 44 that when closed to short across delay line 44 reverses the antenna system radiated beam direction. Coaxial cable feed line 42 is directly connected to 180 degree hybrid output port 46. In the hybrid feed circuits 35 $l_1=l_2-\Delta l$ and $\Delta l=\lambda o/4$ (V.P.) with the whips 31A–D at the respective corners of a rectangle.

Referring now to FIG. 3 an antenna system 30', like 30 of FIG. 1, while the rectangle of the whips 31A–D close to being a square is shown to be mounted on a ground plane sheet 33' that is an upper rear deck surface of a vehicle 47. With the antenna system 30', however, additional feed bars 32C and 32D are shown in dotted lines since only one set of feed bars 32A and 32B or 32C and 32D would be activated at one time. With such operation the feed bars 32A–D have to be selectively connected and disconnected from the respective whips 31A–D with the feed bars operational by parallel opposite side pairs. The hybrid feed circuit 48 shown in FIG. 4 is provided for just such operation and has a signal power transmission input switch 49 switchable for beam front at aft operation with one switch connection to a hybrid feed sub-circuit 35A and the other switched connection to a hybrid feed sub-circuit 35B with the feed sub-circuits 35A and 35B quite similar to the hybrid feed circuit 35 and with like components numbered the same with A's and B's a matter of convenience. While the feed bars 32A–D are straight bars as shown in FIG. 3 they are not shown in that form in FIG. 4 for circuit diagramatic convenience purposes and the base end of each of the whips 31A–D is provided with a two way switch 50A–D that are all drive connected 51 to switch actuator 52 to be simultaneously thrown one way or the other as desired in order that one pair of feed bars 32A–D or the other pair be in the power feed circuit to respective wire-whip outline flat monopoles.

In order to be able to investigate the impedance matching performance of the equivalent-sheet whip array concept, impedance test models were constructed and various locations on a ground plane were tested using an end-fire beam-forming network. The elements were located on a square and on a rectangle and the full-scale whips are standard fiberglass whips with conducting braid embedded in fiberglass, mounted on a spring and base insulator. A single thin monopole (whip) was shown to be poorly matched, and its impedance locus on the Smith Chart generally not useful for complementary matching with the measured impedance plot being for a thin wire with about 0.12 λ height at the lowest frequency. The wire was mounted toward one end of a ground plane. The sum-port impedance for a rectangular array phased into the front/aft direction of the ground plane was done aimed at providing the general concept. The basic idea is, of course, that two whips connected together, as shown in FIG. 1 will behave impedancewise like a fat conical monopole.

Tests showed the input impedances of two whips with a height of 0.16 λ when fed in parallel with by means of horizontal members or bars with it shown that the horizontal feed circuits indeed transform the center of the whip impedance locus towards the center of the Smith Chart, which is a prerequisite for complementary matching, refer to FIGS. 5 and 6. With sum-port input impedances for a fore/aft phasing it is seen that the impedance match at the very low end had deteriorated somewhat, the 3:1 VSWR circle being penetrated above a frequency of approximately 220 MHz instead of 200 MHz. The spacing between whips was a constant 0.12 λ at the lowest frequency. The same is true for the left/-right phasing condition, the two impedance plots being very similar. This implies that the dimensions between the whips are more critical than the ground plane conditions in front of the forward radiating element, i.e., the whole array is matched together as an entity, and independent of ground plane extensions. The patterns, of course, may show more gain reduction in the left/right direction.

One of the many design aspects of a broadband antenna system is the matching network efficiency. In the case of the complementary pair, there is an immediate measure in the power lost in the difference port. With respect to power versus frequency, as one would expect, a significant amount is lost in the difference port at the lowest frequency, where much impedance matching has to be achieved in the complementarization process. A secondary peak appears between 700 and 900 MHz. In both cases, however, the power is down more than 5 dB from the input, meaning that the matching efficiency is better than 50%. Preliminary gain measurements have confirmed a gain of not less than 0 dBi, and up to 6 dBi.

Representative azimuth patterns at 210, 400, 600 and 800 MHz model frequencies for an array phased in the left/right direction showed that even at the lowest frequency there is a front-to-back (i.e. left side-to-right side) ratio of approximately 3 dB, which increases to 6 dB at 400 MHz, 10 dB at 600 MHz, and averages better than 10 dB at 800 MHz. The associated elevation patterns, in the plane of the main beam, show that roll-off varies from about 3 dB over most of the band to about 7 dB at the highest frequency.

Referring now to the basic self-complementary monopole 53 plus-half-loop 56 pair of FIG. 7 a short monopole (whip) 53 and a grounded half-loop 56 is shown. The whip 53 is fed through opening 54 in ground plane 55 and the half-loop 56 is fed through opening 57 in ground plane 55 while the other end thereof is grounded 58 to the ground plane 55. One is an open circuit at very low frequencies, and the other a short circuit. This means that at these frequencies, when connected via lines 59 and 60 hybrid 37' as shown in FIG. 8 the sum-port 36' impedance should be matched.

Tests showed that the measured sum-port impedance from 1.2 to 115 MHz for a whip and a half-loop with 0.002 wavelength height and stretched length (half-circumference), respectively, at 2 MHz. The impedance is not as good as it should be at the low end since the hybrid impedance deteriorates below approximately 5 MHz, with the ground plane too small for frequencies below approximately 5 MHz.

Above approximately 30 MHz (model frequency), the impedance match was suspected not to be as good as possible because the whip 53 was too thin. Remembering that a fat conical monopole has a good high-frequency performance, one might try to improve the high-frequency performance by using a conical monopole. However, the mutual coupling between the loop and the fat monopole will then be too strong, upsetting the self-complementarity. Hence a new radiator approach was evolved, hereinafter described that is capable of optimizing electrically small, self-complementary structures.

There is a well-known equivalency between a fat cylindrical monopole with conical section and a flat sheet of a width equal to twice the diameter of the cylinder diameter. For the frequencies involved in most HF and VHF systems, the dimensions of the radiator are still too bulky and do not lend themselves to easy installation and deployment. The next step in simplifying the structure is now shown in FIGS. 9 and 10 where instead os using a continuous metal surface or sheet, one simulates the sheet monopole 61 that is fed via connection 62 through opening 63 in ground plane 64 to a $\beta$ angled base, by building an outline of the actual radiating structure as shown in FIG. 10 forming a sheet wire outline monopole 61' with opposite side whips 61A and 61B fed by feed line connection 62' through openings 63' in ground plane 64' to horizontal feed bar sections 65A and 65B connected in common 66 to the top of line 62'. The whip insulator and spring mounts 34' are longer than their counterparts in other embodiments with feed bar sections 65A and 65B at upward angles from line 62'. This can be done with such a structure because the radiating currents essentially travel up the extreme edges of the radiator. The center portion does have some effect, particularly at the high frequency end, by virtue of the capacitive field lines connecting to the surrounding plane. Because of this, the optimum angle is almost zero degrees. That is, the optimum equivalent sheet radiator a flat (instead of angled) bottom is most nearly equivalent to the optimized conical section of the cylindrical conical monopole, where the included cone angle is about 60 degrees and $\alpha$ also equals 60 degrees. This angle can be found empirically by varying $\alpha$ until the impedance plot is most ideally centered around the 50-ohm point on the Smith Chart for the widest frequency range. This new equivalent-sheet, wire-outline monopole can now be used in combination with a half-hoop to form a self-complementary pair, where the interaction (through mutual coupling) between the loop and the monopole is minimized by the symmetry and orthogonality of the current-carrying parts of the structure.

A further attempt in improving symmetry can be made by using four whips instead of two, which allows the use of two orthogonal loops also. This is shown in FIG. 11 with an antenna system 30'' mounted on ground plane 33'' with four whips 67A–D mounted by spring and base insulator units 34 on the ground plane sheet 33''. Impedance inverting feed bars 68 and 69 connected at their centers to feed system connection 70 extended through opening 71 in the ground plane sheet 33'' criss-cross interconnect, respectively, whips 67A and 67B, and 67C and 67D. Fat strip half-loop radiators 72 and 72' that are 0.03 wavelength wide at the low frequency are feed line 73 and 73' connected through openings 74 and 74' at the feed ends thereof and ground plane connected 75 and 75' at their other ends. It should be noted that feed network switching and ground plane end switching is useable (complete detail not shown) for radiated beam reversal as may be required.

A VSWR plot of the four-whip arrangement was made for a small pattern model built at 50:1 scale factor so that good patterns could be measured with a limited-size ground plane. The impedance match is obviously excellent (better than 2:1) over a more than 20:1 bandwidth. From 100 to 1000 MHz (full-scale equivalent e.g. 3 to 30MHz) the azmuth patterns show astounding good front-to-back ratios, averaging better than 10 dB. The explanation for this directivity is the fact that, over the entire band where the half-loop is electrically shorter in circumference than the resonant length, the electrical current vector of the half-loop is pointing upward at the feed point, thus enhancing the electrical vector of the monopole which is also pointing up. The electrical vector of the half-loop points downward at the grounded end, and therefore cancels out the monopole contribution. This forms a directional pattern in the direction of the half-loop feed point. This performance is also present when only two whips are used, which are orthogonal in their feed arrangement (e.g., using a center feed bar going underneath the center of the half-loop). With four whips, two orthogonal loops can be installed with four feed points that are alternately switched to the hybrid output or to ground, so that the directional pattern can be switched into four major directions spaced 90 degrees apart (0, 90, 180, and 270 degrees). Whip feed systems could be used such as those shown and described with the embodiments of FIGS. 1 and 2, and 3 and 4.

Improved antenna systems with self-complementary pairs have been described that demonstrate very wide impedance and directional pattern bandwidths. These antennas also are of small physical size in comparison to product-line HF antennas. The "hybrid-fed, wire-outline, eqivalent-sheet-monopole plus half-loop, electrically small, self-complementary pair", warrants further product development production and use in the field. Already impedance bandwidths in excess of 50:1 have been measured, and ultimate bandwidths could be as high as 100:1, with the only limitation being determined by acceptable efficiency.

In an endfire complementary element pair group structure a set of feed cable leads extend from the feed hybrid to the front element and to the rear element of the endfire complementary structure. This is such that the average lengths of the two leads ($L_1+L_{00000}/2$ is equal to an optimum number, i.e. the average length is either mathamatically or empirically adjusted, or selected, to achieve maximum impedance bandwidth, and thereby a minimum mismatch (VSWR) over a maximum frequency range.

In a hybrid-fed endfire complementary pair of two monopoles, either with or without the reflector, the effect of mutual impedance(s) on the sum port match can be minimized by adjusting the average length of the two feed cables. The length differential, as always, is given by the wavelength at the center frequency, such that $\Delta l = \nu o/4 \times V.P.$ where V.P. is the velocity of propagation in the cable, or usually 0.66. The element spacing at the center frequency of a 3:1 band is also $\nu o/4$. Since the front element of the pair has the longer delay cable, one can also determine the optimum length of the cable leading to the front element, or the maximum length in the set. The optimization is achieved by successively varying the two cable lengths, keeping the differential constant, until the best impedance match across the band is achieved.

Whereas this invention has been described with several embodiments thereof, it should be realized that various changes may be made without departing from the essential contributions to the art made by the teachings hereof.

I claim:

1. An antenna system including an electrically complementary pair element group comprising:

electrically complementary pair elements mounted on a conductive material ground plane; with at least one of said electrically complementary pair elements an equivalent sheet monopole simulated by dual radiating whips; insulation mounting means mounting said dual radiating whips to extend upward away from and insulated from said ground plane; a horizontal feed bar interconnecting said dual radiating whips; signal power feed means connected through opening means is said ground plane to the center portion of said horizontal feed bar interconnecting said dual radiating whips; and hybrid feed circuit means connected to feed signal power to both said elements of said electrically complementary pair elements mounted on said conductive material ground plane; wherein said electrically complementary pair elements are configured in an endfire complementary element structure, with a set of feed cables leading from the feed hybrid to the front element and to the rear element of said endfire complementary element structure of such average length $(L_1+L_2)/2$ is equal to an optimum number selected to achieve a maximum impedance bandwidth and a minimum mismatch (VSWR) over a maximum frequency range; wherein said optimum average length is every other odd multiple of an eighth of a wavelength such that Lavg. $=(2N+1)\times\lambda o/8$, where N2, 4, 6 etc. and where $\lambda o$ is the wavelength at the center of the band.

2. The antenna system including an endfire complementary element pair group structure of claim 1, wherein said optimum average length is approximately twenty five inches for a three to one bandwith centered at two hundred MHz.

3. The antenna system including an electrically endfire complementary element pair group structure of claim 1, wherein said hybrid feed circuit means includes an 180 degree hybrid.

4. The antenna system including an electrically endfire complementary pair element group of claim 3, wherein feed lines interconnect opposite signal power output ports of said 180 degree feed hybrid one to each of said complementary pair elements.

5. The antenna system including an electrically endfire complementary pair element group of claim 4, wherein a delay line is included in the line connection of one of the feed lines interconnecting an output port of said 180 degrees feed hybrid and a complementary pair element.

6. The antenna system including an electrically endfire complementary pair element group of claim 5, wherein shorting switch means is connected across said delay line so as to reverse beam direction.

7. The antenna system including an electrically endfire complementary pair element group of claim 4, wherein one of said complementary pair elements is a fat strip half-loop.

* * * * *